US006305655B1

(12) United States Patent
Van Horn

(10) Patent No.: US 6,305,655 B1
(45) Date of Patent: Oct. 23, 2001

(54) GOLF CLUB DISPLAY HANGER

(75) Inventor: Dan Braly Van Horn, Atlanta, GA (US)

(73) Assignee: US Kids Golf, LLC, Norcross, GA (US)

( * ) Notice: Subject to any disclaimer, the term of this patent is extended or adjusted under 35 U.S.C. 154(b) by 0 days.

(21) Appl. No.: 09/491,601

(22) Filed: Jan. 25, 2000

(51) Int. Cl.[7] ..... A47F 5/00
(52) U.S. Cl. ..... 248/301; 248/317
(58) Field of Search ..... 248/301, 317, 248/339, 340, 693, 682, 215; 211/70.2

(56) References Cited

U.S. PATENT DOCUMENTS

| | | | | |
|---|---|---|---|---|
| 3,302,917 | * | 2/1967 | Winkler | 248/317 |
| 3,724,109 | | 4/1973 | Ruegg . | |
| 4,043,453 | | 8/1977 | Greenlee . | |
| 4,149,329 | | 4/1979 | Graves . | |
| 4,572,380 | | 2/1986 | Langwell . | |
| 5,013,004 | * | 5/1991 | Wilkins et al. | 248/692 |
| 5,279,420 | | 1/1994 | Rodgers . | |
| 5,427,343 | * | 6/1995 | Ferris | 248/215 |
| 5,505,351 | | 4/1996 | Najarian . | |
| 5,673,718 | | 10/1997 | Kennedy . | |
| 5,740,911 | * | 4/1998 | Chou | 206/378 |
| 6,062,521 | * | 5/2000 | Kelley et al. | 248/339 |
| 6,164,617 | * | 12/2000 | Butterfield et al. | 248/690 |

* cited by examiner

*Primary Examiner*—Ramon O. Ramirez
*Assistant Examiner*—A. Joseph Wujciak
(74) *Attorney, Agent, or Firm*—King & Spalding

(57) ABSTRACT

A golf club display hanger having a golf club engaging member configured to support the weight of a golf club after the golf club engaging member is inserted through a deformable hole in the golf club's handle. After the golf club engaging member is inserted through the deformable hole, the display hanger engages an interior portion of the golf club. The golf club display hanger and golf club combination can be hung from a stationary hanging support member.

31 Claims, 2 Drawing Sheets

GOLF CLUB DISPLAY HANGER

TECHNICAL FIELD

The invention relates generally to display hangers and particularly relates to display hangers for use in the display of individual golf clubs.

BACKGROUND OF THE INVENTION

Most golf clubs comprise an elongate shaft, a head portion disposed on one end of the shaft, and a tubular rubber handle, which is closed at one end and open at the other, disposed on the other end of the shaft. During manufacturing, this rubber handle is attached to the shaft by feeding one end of the shaft into the open end of the handle. In order to facilitate this process, the closed end of the handle can include a hole which allows air to escape from the interior of the handle as the shaft is fed into the open end of the handle.

After assembly, golf clubs are generally shipped to retailers who traditionally display the golf clubs on free-standing display racks located on a showroom floor. These display racks generally rest on a floor surface and contain individual slots, each of which is dimensioned for receiving the handle and shaft of a golf club. The golf clubs are displayed, head-end up, by inserting the handle-portion of each golf club to be displayed into one of these slots.

This method of displaying golf clubs has several disadvantages. First, because these display racks are free-standing, they take up a significant amount of space. Second, the display racks are structurally complex and thus are relatively expensive to manufacture. Finally, because the display racks do not allow for individual labeling of the golf clubs, the display racks do not allow the user to easily display and promote several different models of golf clubs at the same time.

Therefore, there is a need in the art for a golf club display apparatus that is compact, inexpensive to manufacture, and that allows for individual labeling of the golf clubs.

SUMMARY OF THE INVENTION

The golf club display hanger of the present invention includes a display member, a golf club engaging member, and a hanging member. The golf club engaging member is dimensioned so that it may be removably inserted through a deformable hole in a golf club's handle so that it frictionally engages the interior of the golf club. After the engaging member is inserted into the deformable hole, the display hanger's hanging member may be attached to a stationary hanging support member, such as a display rod, so that the golf club is neatly suspended, shaft-end up, from the display hanger and display rod. The display member may include display indicia that describe and promote the displayed golf club.

Therefore, it is an object of the present invention to provide an improved display hanger for displaying golf clubs.

It is a further object of the present invention to provide an improved display hanger for displaying golf clubs that is compact.

It is a further object of the present invention to provide an improved display hanger for displaying golf clubs that is cost-effective to manufacture.

It is a further object of the invention to provide an improved display hanger that allows for the individual labeling of golf clubs.

It is a further object of the invention to provide an improved display hanger that can be used to suspend a golf club in a handle-end up configuration.

It is a further object of the invention to provide an improved display hanger that can engage an interior portion of a golf club's handle and, as a result of this engagement, support the weight of the golf club.

Other objects, features, and advantages of the present invention will become apparent upon reading the following detailed description of the preferred embodiment of the invention in conjunction with the included drawings and the appended claims.

DETAILED DESCRIPTION OF THE INVENTION

General Configuration and Operation

Figure 1:
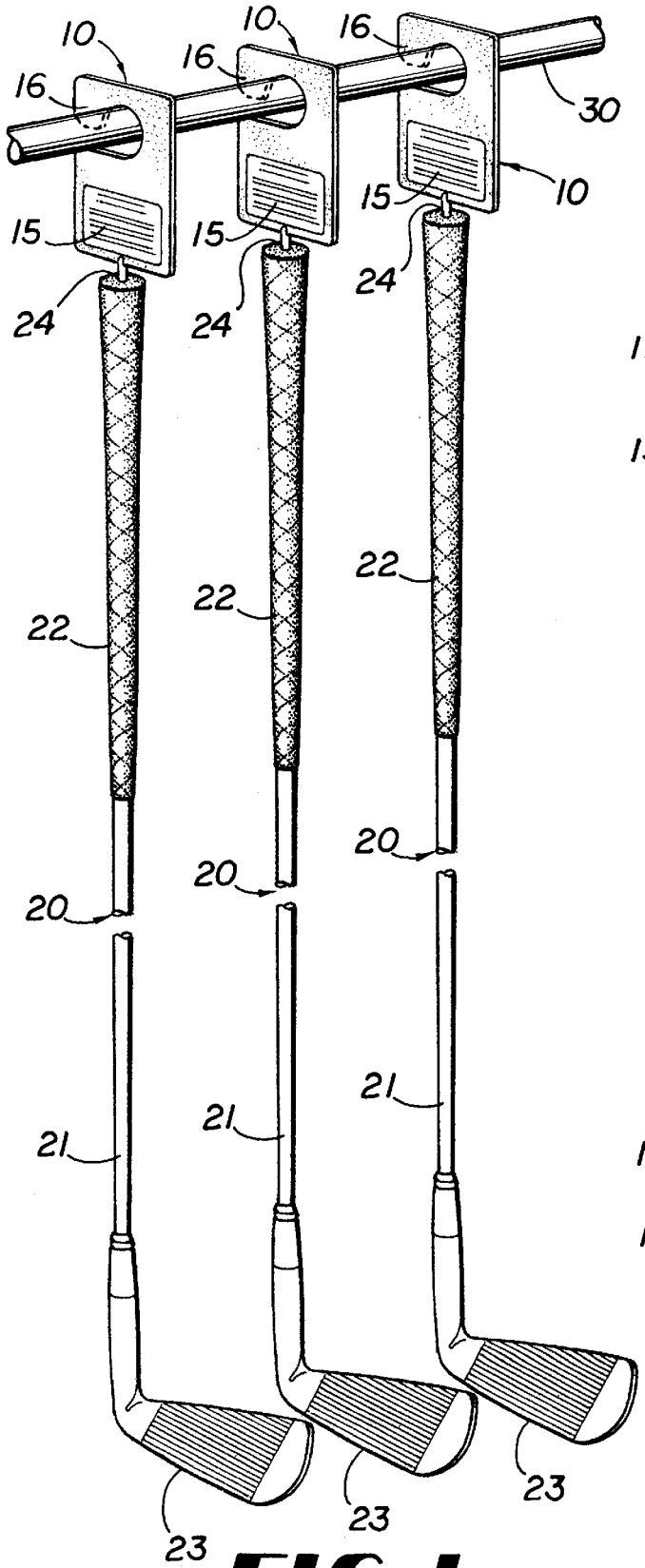
FIG. 1 is a pictorial view of a plurality of golf club display hangers according to a preferred embodiment of the present invention as used to display a corresponding plurality of different golf clubs on a common display rod.
Figure 2A:
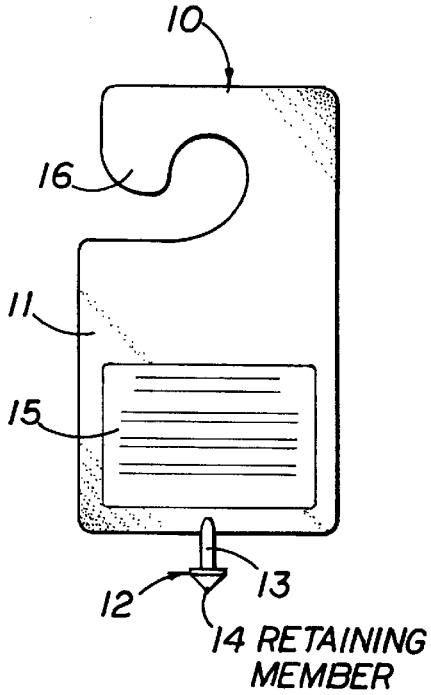
FIG. 2A is a front view of a preferred embodiment of a golf club display hanger according to this invention.

FIG. 1 shows a plurality of golf club display hangers 10 according to a preferred embodiment of the present invention as they are used to neatly display a corresponding plurality of different golf clubs 20 on a common display rod 30. As shown in FIG. 2A, a golf club display hanger 10 according to a preferred embodiment of the present invention is a single-piece element, but may be understood to include "member" portions, namely a display member 11, a hanging member 16 extending from one end of the display member 11, and a golf club engaging member 12 extending from the other end of the display member 11.

The Display Member 11

The display member 11 is preferably planar, but may be of any other suitable configuration, and preferably includes a surface suitable for displaying display indicia 15, which may be included as part of the display hanger 10. The display indicia 15 may be any sort of indicia, but preferably describe and promote a golf club displayed by the golf club display hanger 10. The display indicia 15 may be displayed on the display member 11 in any of the many ways known in the art. For example, the display indicia 15 may be printed on an adhesive label, which may then be affixed to the display member 11. Additionally, the display indicia 15 may be printed, drawn, painted, engraved or molded directly onto the display member 11.

The Golf Club Engaging Member 12

Figure 2B:
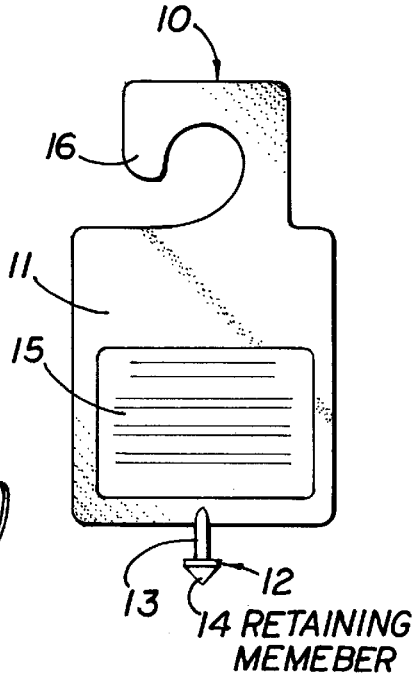
FIG. 2B is a front view of a second preferred embodiment of a golf club display hanger according to this invention.
Figure 3A:
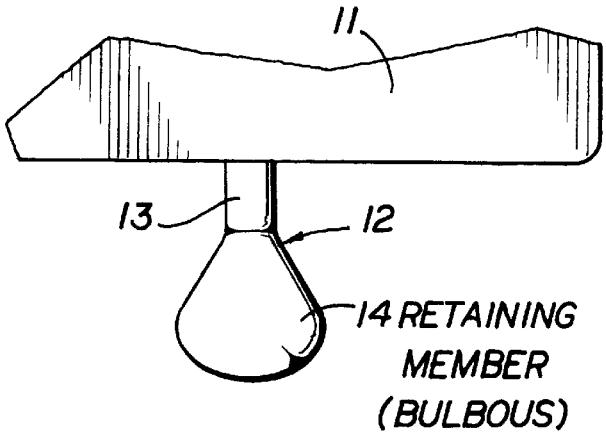
FIG. 3A is a partial front view of an alternative embodiment of a golf club display hanger according to this invention having a bulbous retaining member.
Figure 3B:
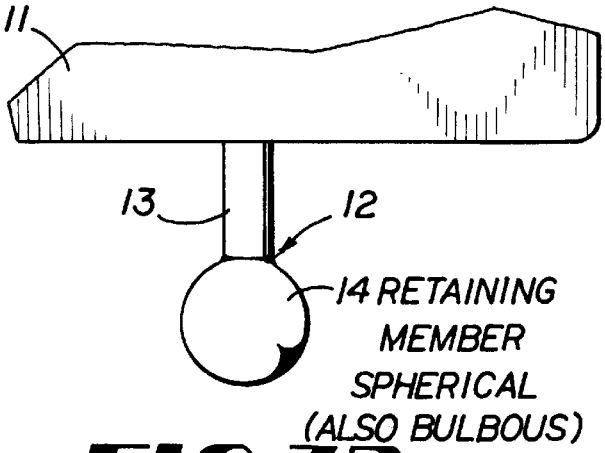
FIG. 3B is a partial front view of an alternative embodiment of a golf club display hanger according to this invention having a spherical, bulbous retaining member.
Figure 3C:
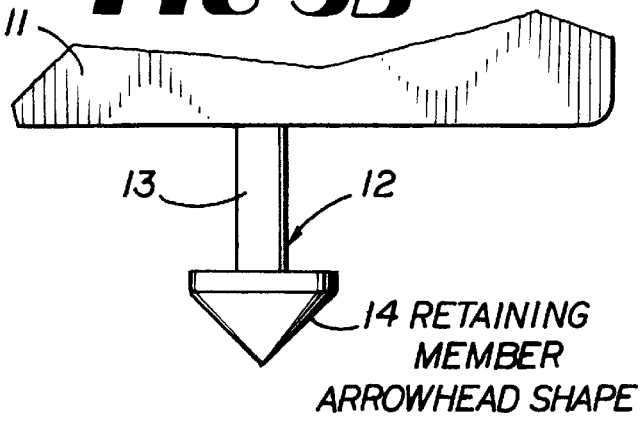
FIG. 3C a partial front view of an alternative embodiment of a golf club display hanger according to this invention having an arrow-head shaped retaining member.
Figure 4:
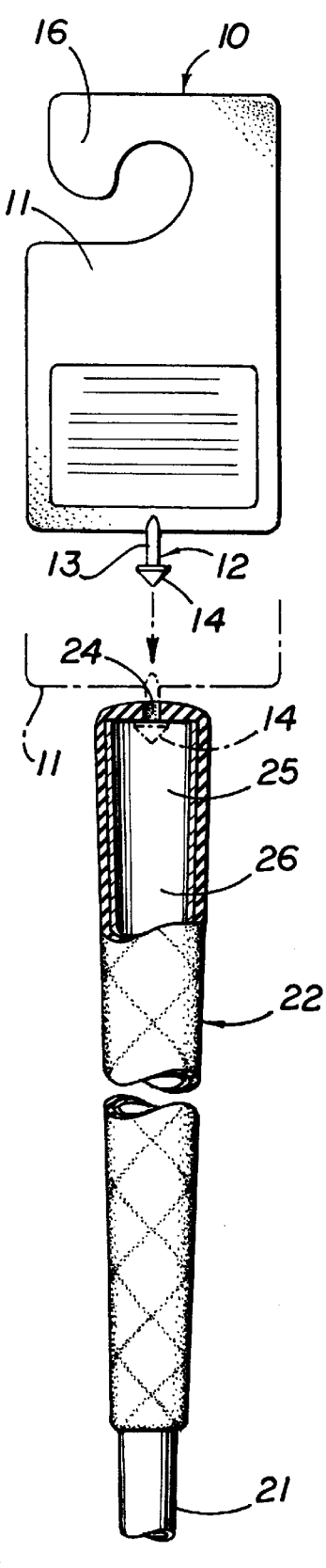
FIG. 4 is a cross-sectional view of a golf club display hanger according to the present invention used in conjunction with the shaft and handle of a golf club. This figure shows that the golf club (shown in cross-section) may be attached to the golf club display hanger (not shown in cross-section) by moving the golf club display hanger relative to the golf club from position 1 to position 2 (shown partially in phantom lines).

As shown in FIGS. 2A and 2B, the golf club engaging member 12 includes a retaining member 14 that is dimensioned for engaging a golf club. As shown in FIGS. 2A, 2B, and 4, the retaining member 14 is conical in one embodiment, but as shown in FIGS. 3A–3C, the retaining member 14 may be bulbous, spherical, arrow-head shaped, or any other shape suitable for insertion into a deformable hole in the handle of a golf club. If the retaining member 14 is conical, the retaining member will have a base end and a tip end, and the diameter of the base end will be larger than the diameter of the tip end. Regardless of the shape of the retaining member, the maximum diameter of the retaining member will preferably be less than about ¼ of an inch for a typical club.

As shown in FIGS. 2A and 2B, the golf club engaging member 12 may also include a through-shaft 13 that connects the display member 11 to the retaining member 14. As will be described in more detail later in reference to FIG. 4, this through-shaft 13 is preferably configured to fit, at least in part, through a deformable hole 24 in the end of a golf club handle 22. The through-shaft 13 is also preferably configured to extend partially into an interior chamber 26 defined by the handle 22 and shaft 21 of a golf club 20 as will be described later. In a preferred embodiment of the invention, the through-shaft 13 is cylindrical and has a diameter of less than ⅛ of an inch. However, the through-shaft 13 may be of any suitable size or shape.

The Hanging Member 16

As shown in FIGS. 2A and 2B, the golf club display hanger 10 also includes a hanging member 16 for suspending the golf club display hanger 10 from a display. Although this hanging member 16 is preferably configured in the form of a hook, the hanging member 16 may be in the form of an eyelet, an aperture, a rod, a member with an adhesive surface, or any other configuration which would allow the golf club display hanger to be suspended from a display.

Structure of a Preferred Embodiment of the Invention

Two preferred embodiments of the invention are shown in FIGS. 2A and 2B. In these embodiments, the display member 11 is substantially planar, the retaining member 14 is substantially conical, the through-shaft 13 is substantially cylindrical, and the hanging member 16 is substantially in the form of a hook. The display member 11 is substantially rectangular in shape and has a top portion and a bottom portion opposite to the top portion. The hanging member 16 is attached to the top portion of the display member 11, and a first end of the through-shaft 13 is attached to the bottom portion of the display member 11. A second end of the through-shaft 13 is attached to the base portion of the substantially conical retaining member 14. As is shown in FIGS. 2A and 2B, the diameter of the through-shaft 13 is preferably smaller than the diameter of the base portion of the retaining member 14. As is shown in FIG. 4, the diameter of the base portion of the retaining member 14 is preferably larger than the maximum width of a deformable hole 24 in a golf club's handle 22 to result in interference therebetween.

Use of a Preferred Embodiment of the Invention

FIG. 4 demonstrates the use of a preferred embodiment of the invention. As shown in FIG. 4, the golf club display hanger 10 is initially moved into a first position (Position 1 in FIG. 4) in which the golf club engaging member 12 is adjacent to the handle 22 of a golf club 20, and in which the axis of the through-shaft 13 is both aligned with the deformable hole 24 defined by the handle 22 and parallel to the axis of the golf club's shaft 21. The golf club display hanger 10 is then moved so that retaining member 14 passes through the deformable hole 24 and into an interior chamber 26 defined by the golf club's handle 22 and shaft 21. After this motion is complete, golf club display hanger 10 is brought to rest in a second position (Position 2 in FIG. 4) in which the retaining member 14 may engage an interior portion of the golf club.

As the golf club display hanger 10 is moved from position 1 to position 2, deformable hole 24 stretches to accommodate the passage of the base portion of the retaining member 14 through the deformable hole 24. After the retaining member's base portion passes through the deformable hole 24, the deformable hole 24 contracts so that the diameter of the deformable hole 24 is again smaller than the diameter of the retaining member's base portion. This may be thought of as providing a "snap-fit" connection.) Because of this, when the golf club display hanger 10 is in position 2, a portion of the golf club's handle 22 overlaps a section of the retaining member's base portion. As a result, when the golf club display hanger is lifted upwardly, a downwardly-facing interior portion of the golf club's handle 22 rests on an upwardly facing exterior surface portion of the base portion of the retaining member 14. Such an interference configuration allows a user to freely suspend the golf club 20 from the golf club hanging member 12 as shown in FIG. 1. The user may then display the golf club by hooking hanging member 16 over a display rod 30 as shown in FIG. 1. If desired, the user may affix display indicia 15 to the display member to describe or promote the golf club 20 while the golf club 20 is on display. The user may later remove the golf club display hanger 10 from the golf club 20 by withdrawing the golf club engaging member 12 from within the deformable hole 24.

Alternate Configurations

As described above, the structural configuration of the various components of the golf club display hanger of the present invention may vary. By the same token, the interface between the golf club display hanger 10 and the golf club 20 to be displayed may also vary. For example, the retaining member 14 may be dimensioned to engage an interior portion of the golf club's shaft 21 rather than an interior portion of the golf club's handle 22. Similarly, the golf club engaging member 12 may include a retaining member 14 that has a maximum diameter that is less than the maximum diameter of the through-shaft 13, or, alternatively, the golf club engaging member 12 may include only a through-shaft 13 and no retaining member. In such a configuration, the weight of the golf club may be supported by the frictional engagement between the through-shaft 13 and the deformable hole 24. Additionally, the golf club engaging member 12 may be configured to collapse before insertion through the deformable hole 24 and expand once inserted into the deformable hole 24.

CONCLUSION

While this invention has been described in specific detail with reference to the disclosed embodiments, it will be understood that many variations and modifications may be effected within the spirit and scope of the invention as described in the appended claims.

What is claimed is:

1. A golf club display hanger for suspending a golf club from a stationary hanging support member, said golf club having a deformable hole defined by a handle of said golf club, comprising:

a display member;

a hanging member extending from one end of said display member and configured to detachably engage said stationary hanging support member; and a golf club engaging member extending from another end of said display member, said golf club engaging member comprising a through-shaft and a retaining member disposed on said through-shaft, said retaining member being configured for removable insertion into said deformable hole so that, after said retaining member is inserted into said deformable hole, said retaining member detachably engages an interior portion of said golf club sufficiently to solely support the weight of said golf club, and so that said golf club engaging member can be attached to said golf club and said golf club display hanger can be hung on said hanging support member, thereby suspending said golf club.

2. The golf club display hanger as claimed in claim 1, wherein said retaining member frictionally engages an interior portion of a chamber defined by said handle and said golf club shaft.

3. The golf club display hanger as claimed in claim 1, wherein said retaining member engages, by interference, an interior portion of a chamber defined by said handle and said golf club shaft.

4. The golf club display hanger as claimed in claim 1, wherein said through-shaft is configured for removable placement into said deformable hole.

5. The golf club display hanger as claimed in claim 1, wherein a maximum width of said retaining member is greater than a maximum width of said deformable hole.

6. The golf club display hanger as claimed in claim 1, further comprising display indicia disposed on said display member.

7. The golf club display hanger as claimed in claim 6, wherein said display member is substantially planar.

8. The golf club display hanger as claimed in claim 7, wherein said retaining member is substantially conical.

9. The golf club display hanger as claimed in claim 1, wherein said retaining member is substantially conical.

10. The golf club display hanger as claimed in claim 9, wherein a maximum diameter of said retaining member is greater than a diameter of said deformable hole.

11. The golf club display hanger as claimed in claim 10, wherein said retaining member has a base end and a tip end, and wherein said through-shaft engages said base end of said retaining member.

12. The golf club display hanger as claimed in claim 11, wherein said diameter of said base end of said retaining member is greater than a diameter of a portion of said through-shaft that engages said base end.

13. The golf club display hanger as claimed in claim 9, wherein said hanging member is substantially in the shape of a hook.

14. The golf club display hanger as claimed in claim 1, wherein said retaining member is substantially bulbous.

15. The golf club display hanger as claimed in claim 14, wherein a maximum width of said retaining member is greater than a maximum width of said through-shaft.

16. The golf club display hanger as claimed in claim 1, wherein said retaining member is spherical.

17. The golf club display hanger as claimed in claim 16, wherein a maximum width of said retaining member is greater than a maximum width of said through-shaft.

18. A golf club display hanger for holding up a golf club, said golf club having a deformable hole defined by a handle of said golf club, comprising:

a planar display member having a first end, and a second end opposite said first end;

a substantially conical retaining member disposed adjacent said first end of said planar display member;

a substantially cylindrical through-shaft disposed between said display member and said retaining member, said through-shaft mechanically connecting said retaining member to said first end of said display member;

a hanging member disposed on said second end of said display member; and wherein said retaining member has a base end and a tip end, wherein a diameter of said base end is larger than a diameter of said tip end, and wherein said retaining member is configured so that it may be first inserted into said deformable hole and then positioned so that said retaining member engages an interior portion of said golf club handle to solely support the weight of the golf club.

19. The golf club display hanger as claimed in claim 18, wherein said diameter of said base end of said retaining member is greater than a diameter of a portion of said through-shaft that engages said base end.

20. The golf club display hanger as claimed in claim 18, further comprising display indicia disposed on said display member.

21. The golf club display hanger as claimed in claim 18, wherein said hanging member is substantially in the shape of a hook.

22. The golf club display hanger as claimed in claim 18, wherein said retaining member is dimensioned so that when said retaining member engages said interior portion of said handle, a weight of said golf club may be supported by said retaining member and said through-shaft.

23. A method of hanging a golf club, said golf club having a deformable hole defined by a handle of said golf club, comprising the steps of:

providing a golf club display hanger for hanging said golf club, said golf club display hanger comprising a hanging member and a golf club engaging member configured for removable insertion into said deformable hole; and inserting said golf club engaging member into said deformable hole so that said golf club engaging member frictionally engages an interior portion of a chamber defined by said handle and a shaft of said golf club to solely support the weight of the golf club.

24. The method of hanging a golf club of claim 23, further comprising the step of hanging said hanging member so that said golf club is suspended from said golf club display hanger.

25. The method of hanging a golf club of claim 23, further including the step of displaying product information on said golf club display hanger.

26. The method of hanging a golf club of claim 23, wherein said golf club engaging member comprises a through-shaft and a retaining member, and wherein a width of said retaining member is greater than a width of said through-shaft.

27. The method of hanging a golf club of claim 26, wherein a maximum width of said retaining member is greater than a maximum width of said deformable hole.

28. The method of hanging a golf club of claim 23, wherein said hanging member comprises a hook member.

29. A method of hanging a golf club comprising the steps of:

providing a golf club display hanger for hanging said golf club, said display hanger comprising a hanging member, a display member, a through-shaft, and a retaining member, said retaining member having a base end and a tip end, and wherein a diameter of said base end is larger than a diameter of said tip end;

inserting said retaining member through a deformable hole in a handle of a golf club so that said deformable hole first deforms as said base end passes through said deformable hole and then contracts so that a diameter of said deformable hole, after said retaining member has passed through said deformable hole, is smaller than a diameter of said base end of said retaining member; and positioning said retaining member so that said retaining member engages an interior portion of a handle of said golf club.

30. The method of hanging a golf club of claim 29, further comprising the step of displaying display indicia on said golf club display hanger.

31. The method of hanging a golf club of claim 29, further comprising the step of hanging said golf club display hanger and said golf club from a display.

* * * * *